United States Patent [19]

Para

[11] 4,225,248

[45] Sep. 30, 1980

[54] DEVICE FOR MIXING AND METERING THE CONTENTS OF CONTAINERS, PARTICULARLY FOR PAINTS, DYES AND THE LIKE, AND SHELF OR SHELVING ADOPTING SUCH A DEVICE

[76] Inventor: Serenella F. Para, Via Campo dei Fiori 14, 21020 Luvinate, Italy

[21] Appl. No.: 926,019

[22] Filed: Jul. 19, 1978

[30] Foreign Application Priority Data

| | | | |
|---|---|---|---|
| Jul. 21, 1977 | [IT] | Italy | 25968 A/77 |
| Jul. 28, 1977 | [IT] | Italy | 26243 A/77 |
| Feb. 6, 1978 | [IT] | Italy | 20023 A/78 |

[51] Int. Cl.[3] ..... B01F 13/08; B01F 15/04; B01F 7/16

[52] U.S. Cl. ..... 366/251; 366/153; 366/273; 366/605

[58] Field of Search ..... 366/273, 274, 605, 247, 366/152, 153, 142, 198, 251

[56] References Cited

U.S. PATENT DOCUMENTS

| | | | |
|---|---|---|---|
| 2,549,121 | 4/1951 | Osterheld | 366/274 |
| 2,702,571 | 2/1955 | Murray | 366/274 |
| 2,802,649 | 8/1957 | Stockton | 366/605 |
| 3,116,913 | 1/1964 | Lane | 366/274 |
| 3,162,338 | 12/1964 | Grubelic | 366/605 |
| 3,362,692 | 1/1968 | Iannone | 366/274 |
| 3,384,353 | 5/1968 | Worth | 366/274 |
| 3,572,651 | 3/1971 | Harker | 366/274 |

FOREIGN PATENT DOCUMENTS

| | | | |
|---|---|---|---|
| 1026902 | 2/1953 | France | 366/274 |
| 1180278 | 2/1970 | United Kingdom | 366/605 |
| 1344920 | 1/1974 | United Kingdom | 366/605 |
| 1401226 | 7/1975 | United Kingdom | 366/605 |

*Primary Examiner*—Robert W. Jenkins
*Attorney, Agent, or Firm*—Fleit & Jacobson

[57] ABSTRACT

A stirring device for mixing the contents of containers or vessles, particularly for paints; dyes and the like, comprising at least one first magnetic mechanism enclosed within a fixed seat or housing and which is rotatably driven, and a second magnetic mechanism; cooperating with each corresponding first magnetic mechanism and associated with a stirring shaft of a container or vessel bearing on the closing or covering plate of said seat or housing, to transfer the rotation of the first magnetic means to the second magnetic mechanism and stirring shaft, at the same time holding the container pressed against said closing or covering plate of the seat or housing, and accordingly at a fixed condition. A metering device is also provided for metering the different contents of a mixture.

14 Claims, 9 Drawing Figures

DEVICE FOR MIXING AND METERING THE CONTENTS OF CONTAINERS, PARTICULARLY FOR PAINTS, DYES AND THE LIKE, AND SHELF OR SHELVING ADOPTING SUCH A DEVICE

This invention is concerned with a stirring device for mixing and metering the contents of containers, particularly but not exclusively advantageous for paints, colors or dyes and other solutions with dispersed materials. This invention is also concerned with a shelf and shelving for mixing and in the case metering the contents of a plurality of containers.

Shelvings are known for simultaneously mixing the contents of a plurality of containers containing different colours, wherein the individual containers or vessels are provided with a stirring shaft fitted with blade means, the shaft being rotatably driven by a mechanical system applied thereto and exiting from the container or vessel cover and such to be driven from the top by means of a coupling. However, such a mechanical system suffers from various disadvantages, namely being of excessive overall size in height, noisy, liable to wearing and requiring a considerable maintenance or servicing, further enabling the rotation of the stirring shaft in only one direction, with not a thorough mixing of the product.

Scale or weight metering devices are also previously known. It is the disadvantage of such devices that metering has to be carried out by controlling both the scale pointer and the inlet or mouth-piece of the container or vessel into which the operator is pouring the liquid. Thus, it is difficult to attain a good accuracy. Volume metering devices have been also used, wherein although the operator could see the interior of the container or vessel, the warning for the attainment of a given volume was dubious mainly because of the limited volumes, the mark of which was close to the container or vessel bottom. Finally, in these devices it was difficult to vary the levels when another mixture had to be prepared.

It is the primary object of the present invention to overcome the above mentioned disadvantages, that is to provide a mixing system which is reliable, noiseless and of minimum overall size.

It is another object of the present invention to provide a volumetric metering device assuring a perfect or th-orough mixing of successively produced compositions and a ready change in meterings either maintaining identical percentages or varying the same when providing different mixtures. It is another object to immediately display the preselected percentages.

The primary object has been accomplished by providing at least one first magnetic means enclosed within a fixed seating and which is rotatably driven, and a second magnetic means cooperating with the corresponding first magnetic means, which is associated with the stirring shaft of a container or vessel leaning on the top of said fixed seating, so as to transfer the rotation from said first magnetic means to said second magnetic means and accordingly to the stirring shaft, at the same time maintaining the container or vessel pressed against the seating top.

A specific solution of the invention contemplates that the rotation of the magnetic means is inverted, in the case by an automatic device.

The present invention is also concerned with the arrangement in one or more rows of said first magnetic means and associated second magnetic means and the shelf or set of superimposed shelves making up a shelving which are obtained by adopting such expedients.

According to a preferred embodiment of the invention, it is contemplated that the magnetic means comprise four pole pieces having alternate polarities, which are mounted on a rotating support and preferably comprise ceramic magnets that are oriented and transversely magnetized on the major surfaces.

A first solution of the invention provides that the motion to the rotating supports is imparted by means of a belt driven by a driving pulley, said belt being stretched by a series of common idle rollers.

On the other hand, a second solution of the invention provides that the rotating supports are carried on gear wheels meshing with one another and one of the gear wheels meshing with the driving pinion, said wheels being preferably made of nylon or the like, particularly Derlin manufactured by Baker, loaded with molybdenun bisulphide, thereby being rendered self-lubricating, with the result of avoiding any maintenance or servicing.

This solution also accomplishes the object of causing alternatively each stirrer to rotate in a different direction relative to the direction of the adjacent stirrers, so that a simple exchange in position of the cans causes a change in the mixing direction thereof.

In this particular case, it is also contemplated that the pole pieces are preferably mounted coaxially with the gears, so as to be fast or integral therewith. Further, the attachment of each gear to the underlying planar sheet or plate is preferably carried out by means of a pin passing through the axial hole in each gear, said pin being secured to the sheet or plate by means of riveting.

An improvement according to the invention further contemplates that the fixed seating enclosing said first magnetic means is provided with a heating system. In this case, two resistances are advantageously provided as laterally arranged with respect to the magnets. It is also preferred to provide an outer insulation for said resistances, so as not to increase unnecessarily the temperature of the external zones not contacting the containers or vessels and product any casual contact therewith.

It is a further improvement of the invention to provide a covering sheet or plate on each fixed seating containing said first magnetic means, having the cans bearing thereon, the contents of which are to be mixed. Said covering sheet or plate has formed thereon as many raised portions as the first magnetic means accomodated in each fixed seating, and a container or can will be inserted on each of such portions, so that the projecting outer edge of each can will rest on the lowermost portion of the cover, the latter remaining thereby fully secured to the operating member and at the same time moving as closely as possible the operating magnets to the bottom of each container or can.

A particular embodiment of the invention provides a rod type of level indicating device, which can be preset in place by an electronic control circuit including a control pulse generator supplying a motor for upward or downward moving the rod of the level indicating device, associated with a local oscillator through a divider means to allow a plurality of prearrangements for the final filling level, and an electronic counter and related displaying means for subsequent indication of the single doses or amounts of the various components set by a selecting device.

According to the present invention, a level indicating device is also provided as comprising a plate which is slightly inclined relative to the liquid level and which by means of a notch, preferably located on an edge also inclined relative to the free liquid surface provides a quite clear, accurate indication as amplified due to the liquid surface tension. Another type of level indicating device generates a glow or flash when the liquid reaches a predetermined level, this assuring a correct metering, since an operator will more readily see such a flash than he can see a common level signal or mark. In this case, a pre-indicator could also be provided for signalling the occurrence of approach to the predetermined level.

The invention will now be further described in connection with exemplary embodiments that have been shown in the accompanying drawings, in which.

The shelving herein shown will be particularly described with reference to mixing and metering of paints and the like, although being suitable for much more extended applications.

Figure 1:
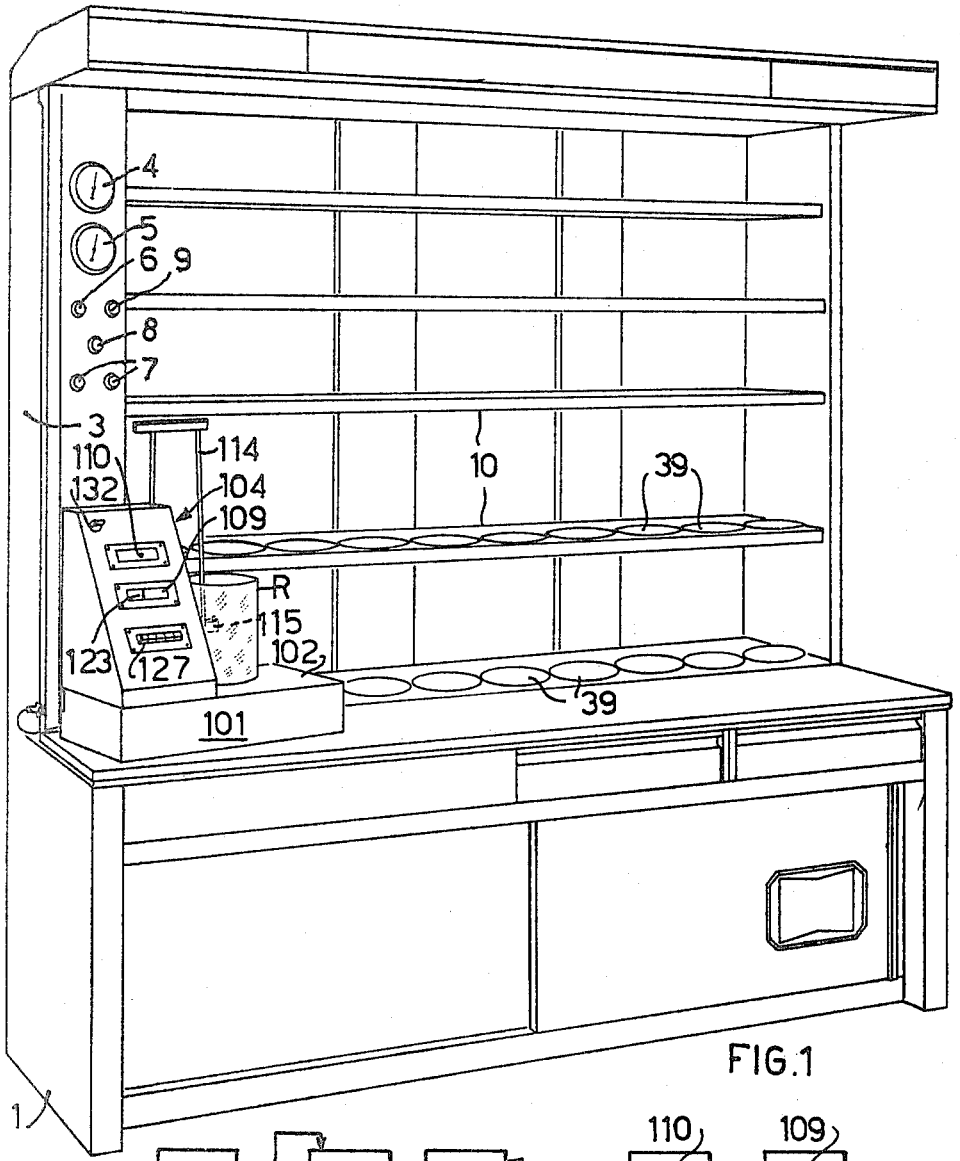
FIG. 1 is a perspective general view of a shelving according to an embodiment of the present invention.
Figure 2:
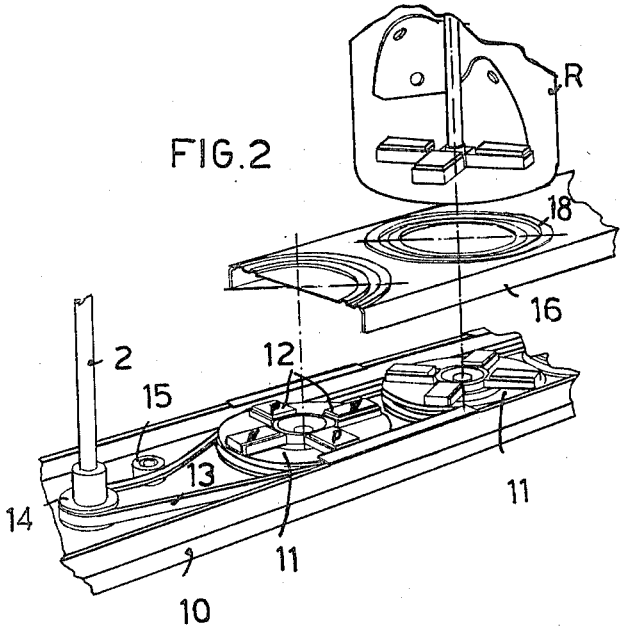
FIG. 2 is an exploded view showing a stirring device according to the present invention for use in the shelving of FIG. 1, in which also a container or vessel is also schematically shown.
Figure 3:
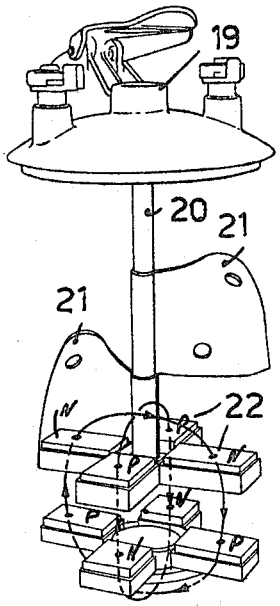
FIG. 3 is a perspective general view of the stirring device, in which the pattern of the magnetic flux lines for the intercoupling of the magnetic means has been particularly pointed out.

Referring first to FIGS. 1 to 3, it will be seen that a shelving has a base 1 (FIG. 1), carrying thereon an electric motor (not shown) selectively rotating in opposite directions, the driving shaft 2 of which (FIG. 2) vertically extends in a side 3 carrying an instrumentation comprising a thermometer 4, a hygrometer 5 (defining the enviromental conditions), a switch 6 responsive to a remote control to light the glass ceiling lamp mounted at the illumination top of the shelving, warning lights 7 for indicating the operating conditions, a timer 8 for presetting the apparatus operating time, and an automatism 9 for presetting the operation in successively alternating directions of the motor. Preferably, the electric controls are operated at a low voltage (12 volts).

Said base 1 has mounted thereon the actual shelving comprising a plurality of shelves, the number of which will differ depending on practical requirements. An automatic wrapping curtain (not shown) is for shielding or protection against dust. As better shown in FIG. 2, each shelf 10 comprises a box-like element forming a seat or housing for a row or series of supports comprising pulley discs 11, each of which carrying on its upper face permanent spider-arranged magnets 12, having alternating positive and negative magnets P and N, respectively. Preferably, such magnets are ceramic type of magnets, that is comprising oriented ceramic magnets as magnetized transversely on the major surfaces.

Discs 11 are driven by a continuous belt 13 entrained within the groove of said disc and in that of a pulley 14 keyed to driving shaft 2. Idle rollers 15 assure pressure engagement of belt 13 in the grooves of discs 11 and pulleys 14 and accordingly allow the drive from shaft 2 to magnet carrying discs 11. The direction of rotation for magnet carrying discs 11 corresponds to that of shaft 2, that is of the drive motor, whereby by reversing the direction of rotation of the drive motor, the direction of rotation of the magnet carrying discs will be reversed. Each shelf 10 is closed at the top by a covering sheet or plate 16 forming a bearing plane for containers or vessels R and having means for the bearing of such containers or vessels at centered position relative to underlying magnet carrying disc 11. Such means could comprise positioning grooves 18, drawings or stop stakes (not shown).

Each container or vessel R is provided with a cover 19 (FIG. 3) which can be clamped at closing position or condition, in the case with a transfer opening. It is provided with a bearing (not shown) for centrally rotatably mounting a stirring shaft 20 fitted with mixing blades 21. This stirring shaft 20 terminates at the bottom with a spider of magnets 22, the latter being alternatively of positive and negative type P and N, respectively. Also said elements 22 are preferably oriented ceramic magnets transversely magnetized on the major surfaces, that is similar to elements 12. However, other known permanent magnets could be obviously adopted, but magneto-ceramic materials are preferred in case of contact with paints or the like, such as the present case. Electromagnets could also be adopted, but this would complicate the construction of the apparatus. Magnets 22 are arranged on corresponding magnets 12, so that magnets 22 of positive type P are exactly superimposed to magnets 12 of negative type N and similarly magnets 22 of negative type N are exactly superimposed to magnets 12 of positive type P, so that these pairs of magnets, the linked flux of which is shown by dashed-dotted lines in FIG. 3, build up a mutual attractive force tending to maintain container or vessel R in pressed relationship against bearing plane 16. Further, due to this magnetic action, rotation of magnets 12 is transferred to magnets 22.

The operation of the above described apparatus is as follows: By presetting timer 8, the motor is connected, causing shaft 2 to rotate and drive magnet carrying discs 11 and by magnetic action said stirring shafts 20 of containers or vessels R, so that the contents are mixed. If automatism 9 has also been preset, the motor will alternatively reverse its direction of rotation for short predetermined periods, and accordingly the direction of rotation for stirring shafts 20 will vary, with a resulting improved mixing of the material in containers or vessels R. At the end of the time period preset by the operator through said timer 8, the apparatus will automatically stop.

The containers or vessels R, that had been placed on the apparatus shelves after having been closed by respective covers 19, at a centered position relative to underlying discs 11, can now be withdrawn for pouring the contents or for other operations.

Figures 4, 5:
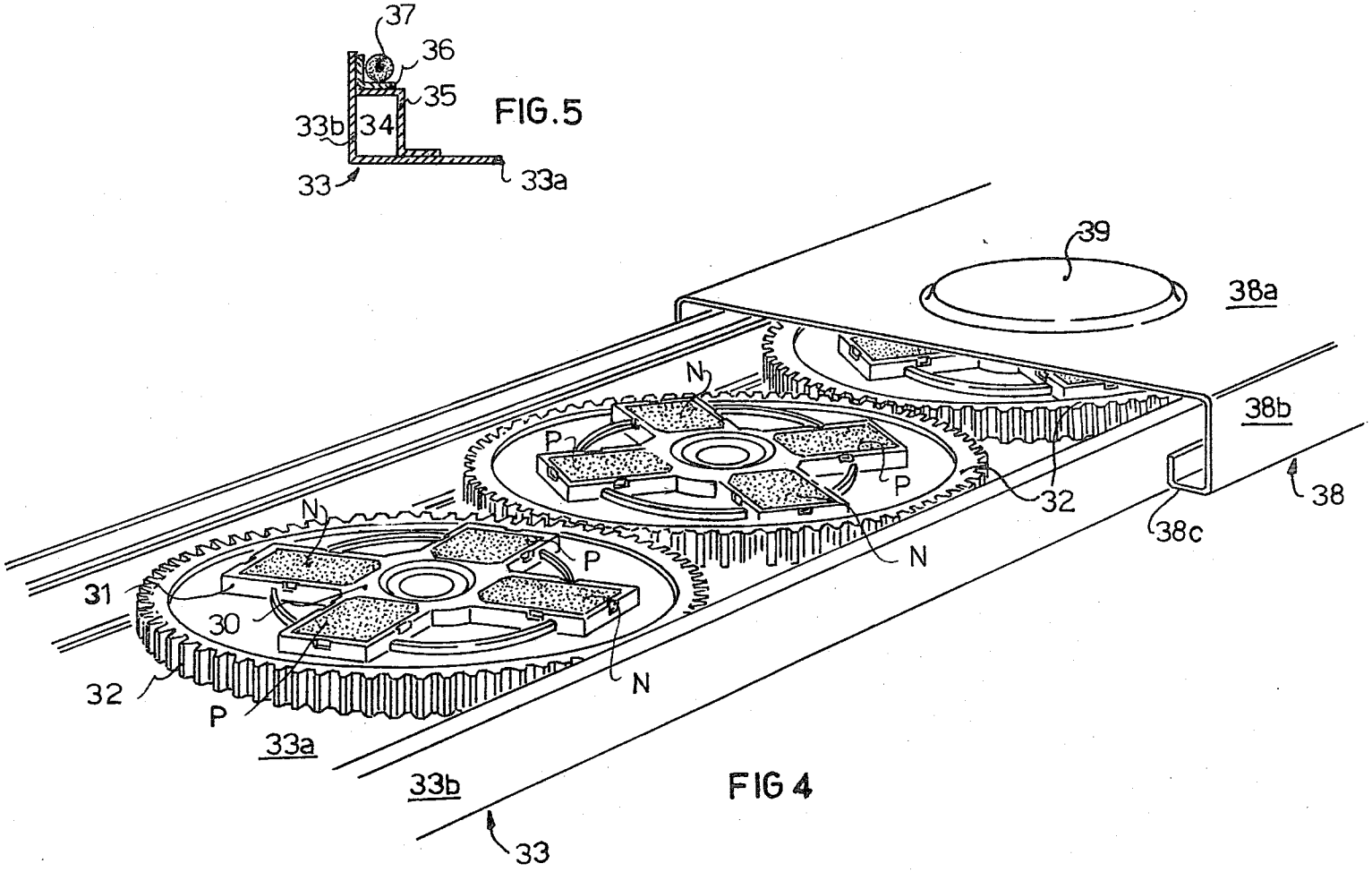
FIG. 4 is a perspective view of a second embodiment for the fixed seating containing a further operating device according to the present invention.
FIG. 5 is a sectional view for one of the edges of the seating shown in FIG. 4.

Referring now to FIGS. 4 and 5, an embodiment differing from the above embodiment will now be described. Pole pieces N and P, as alternatively arranged, are mounted on a support 30 provided with arms 31 for receiving said pole pieces. This support 30 is mounted to be concentric and integral with respective gear wheel 32.

Gear wheels 32 are caused intermesh, as shown in FIG. 4. One of these gear wheels 32 and particularly, when using a shelving with side shoulders, one of the two end wheels, is brought to mesh with a pinion (not shown), which is driven by a shaft operated by a geared motor (also not shown in these schematic representations). Preferably, this shaft is of a sufficient height for supporting several pinions, one for each bearing plane, should a multiplane shelving be provided.

The several gears 32 are housed within a fixed seat or housing 33 formed of a box-like element comprising a lower flat portion or bottom 33*a* and two vertical side portions 33*b*.

Fastening or attachment of said several gears 32 is carried out by suitably drilling at a proper position the sheet or plate of bottom 33*a* and in each of these holes inserting a gudgeon acting as a pin for gear 32 and which is secured to said sheet or plate of bottom 33*a* by riveting. While not being the only possible system, this fastening system proved to be in practice very advantageous and economical.

Preferably, the gears are made of nylon or the like, particularly Derlin manufactured by Bayer, loaded or charged with molybdenum bisulphide, so as to be self-lubricating and thereby avoid any maintenance or servicing.

It should now be noted that the geared construction herein described further provides the advantage of causing the adjacent stirrers to rotate alternatively in opposite directions. Thus, and without providing any automatism for stopping and reversing the direction of rotation for the primary electric motor, one only needs to displace the position of a can that its relative stirrer would reverse the direction of rotation. Said edge 33*b* of the box-like element is internally provided with a longitudinal recess 34, which is formed by applying to the corner of fix seat or housing 33 a L- or Z-shaped element 35, the latter being welded to form a chamber 34 preventing heat dispersion.

A L-shaped coating, designated by reference numeral 36 and made of asbestos or the like, is provided as secured on chamber 34.

Said asbestos coating 36 has placed thereon an armored resistance of stainless steel tube 37 which extends throughout the shelf formed by said box-like element 33. By such an arrangement, each shelf is internally heated without having its side edge reaching an undue temperature. Generally, said resistance is adjusted so that the temperature attained by each of the shelves is about 50° C. Obviously, the resistance is provided with a coating, preferably Teflon, removing any shortcoming due to any casual contacts.

A covering of sheet or plate 38 is placed on fixed seat or housing 33 and comprises a top flat portion 38*a* and two downward directed vertical portions 38*b*, which are preferably provided with a double bending 38*c*. Said horizontal flat surface 38*a* has impressed thereon several ridges or raised portions 39 (only one of which is shown in FIG. 4) that have a shape exactly corresponding to the inner portion of the bottom of an edged container or can, that is to the portion internally compressed to the circular edge projecting from each bottom of the containers or vessels. Thus, the side edge of the can bottom will bear on said surface 38*a* of the covering sheet or plate for the shelf, whereas the recessed inner bottom of the can will bear on said raised surface 39. These ridges or raised surfaces 39 are so arranged as to correspond exactly to each pole piece comprising N and P type of magnets and the spacing thereof from said magnets is minimized, so that the magnets contained in the shelf are very close to the magnets contained in each container or vessel and supported by the cover thereto applied, as explained in connection with FIGS. 2 and 3.

Thus, no difficulty would arise in cleaning said covering sheet or plate 38, since the external parts thereof do not have any upward projecting bumps.

As apparent, the shelving shown in FIG. 1 would allow to mix the contents of a plurality of containers or vessels, since said shaft 2 will rotatably drive, preferably in alternate directions, the rows of the magnetic means provided in the individual shelves, while the same drive system by magnetic means could be adopted for individual shelves or for individual containers or vessels.

In the case of the embodiment shown in FIGS. 2 and 3, means could also be provided for releasing the individual pulleys 14 to enable the mixing for the containers or vessels supported by the only shelves 10 associated with connected pulleys 14.

Figure 6:
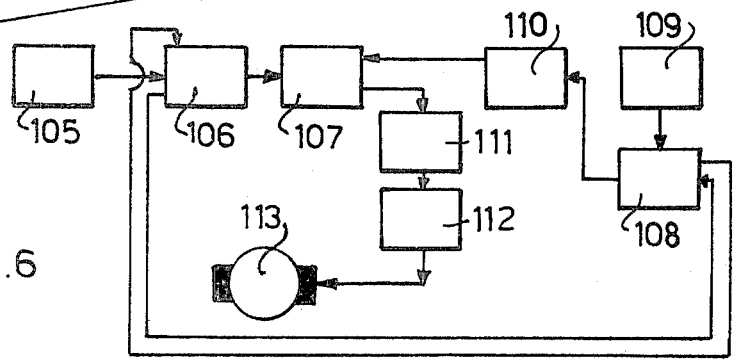
FIG. 6 is a block diagram for the electronic control circuit of the volumetric metering device.

Referring again to FIG. 1, the description will now be given for the volumetric metering device therein shown. Such a device comprises a base 101 having a bearing plane 102 for a container or vessel R, into which the basic colours will be poured for preparing the composite colour. A control board 104 upward branches from said base 101 and contains the electronic control system, preferably comprising integrated circuits, and a block diagram of which is shown in FIG. 6. In the circuitry shown, such a block circuit comprises a local oscillator 105, the output of which supplies a drive and control stage 106 supplying a divider 107 (such as a five position divider) and a comparator 108 preset by a selector 109, which comparator 108 supplies a control output to stage 106 and an output to a counter-displayer 110 and then to divider 107. Preferably, the displayer is of light decade type. The output of divider 107 supplies a sequential generator 111 which supplies pulses to a pilot or drive stage 112, the latter operating a square pulse stepped motor 113, the shaft of which imparts through a worm bevel gear pair a corresponding lifting or lowering movement for a rod 114 of a level indicating device.

Figure 7:
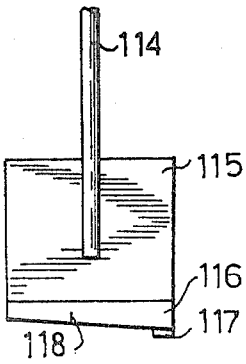
FIG. 7 is an enlarged view of a first embodiment of a level indicating device for metering device.
Figure 8:
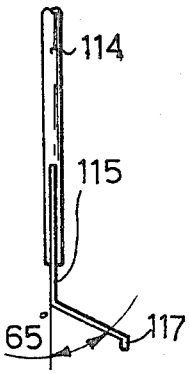
FIG. 8 is a side view of the detail of FIG. 7.

At the bottom this device terminates with a lamina 115 (FIGS. 7 and 8) having a portion 116 inclined of about 65° relative to the vertical. It terminates with a vertical projection 117 and has a cutor identation 118 for breaking the liquid surface tension, which is positioned slightly inclined to the free surface of the liquid to allow a better display of the liquid level.

Figure 9:
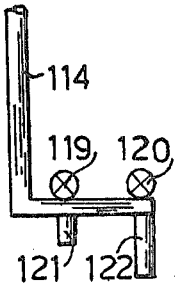
FIG. 9 is a view showing a second embodiment of a level indicating device for use in a metering device.

Still better results are achieved by using the level indicating device according to the embodiment shown in FIG. 9. In such a solution, hollow rod 114 terminates with a base carrying a first microlamp 119 and a second microlamp 120 inserted between a wire passing through said hollow rod 114 and the base of container or vessel R by two conductive legs 121 and 122, respectively, of a different length. Under the condition of metering start, said leg 122 touches the bottom of the container or vessel, whereby lamp 20 is extinguished. When rod 114 is lifted to a predetermined level defined by leg 21, both of said lamps are extinguished. As the level of the liquid being poured into the container or vessel rises, the liquid first touches leg 122 lighting although at a reduced degree said lamp 120 due to the electrical resistance of the liquid, this indicating that the remaining portion of the liquid should be more carefully poured, the liquid pouring ending as soon as lamp 119 lights up. Therefore, there is no risk of pouring an excessive amount or dose of liquid.

At said five position divider 107, a control panel is provided and contains a rotary switch 123 of five position or way type and possible signalling lamps, not shown.

On the front side of control board 104 and above said rotary switch 123, a panel is provided as carrying a light display 110, electronically displaying the amounts time by time selected, as explained in the following in the described example. Quantity selector 109 selects the quantity or amount time by time desired for each formulation embodying a mixture. Automatic zero setting for said light display 110, when rod 114 is at position of bottom or top limit stop, is effected by means of a push-button in a push-button panel 127. This push-button panel 127 is also provided with further push-buttons, such as for free upward movement of the rod, free downward movement of the rod, for embodying the formulation, as well as a general pushbutton for stop purposes. Finally, a main key switch 132 is for providing the supply (12 volts) to the whole assembly.

Such an apparatus could also be provided with a light device for subsequently displaying the individual formulations as printed on microfilms.

The operation of the above described electronic metering device is as follows:

Having decided the amount of composite product to be prepared, the choice is then made for the container or vessel R of desired capacity and the corresponding position of the divider by means of said rotary switch 123. For example, for preparing 3000 cc of product, a 4000 cc container at position III, or a 6000 cc container at position I could be chosen, depending on whether possible successive additions of further products are contemplated, that is depending on whether a more or less filled container is desired to be provided. Thus, said rotary switch 123 defines the final height of the mixture, while the size of the container will define the actual volume of the mixture being obtained. Assume to choose a 6000 cc container. Then, such a container R is placed under rod 114, the latter having been previously moved to its maximum lifting position, position I is set, and the formulation push-button is depressed, so that edge 117 or leg 122, according to the type of level indicating device being used, will touch the bottom of container R. Then, selector 109 is set to the value of the first component provided by the known type of volumetric formula on base 1000 cc, the value set on the display is controlled and the "formulation" push-button is depressed with a resulting lifting movement of rod 114 from motor 113, the movement of which will depend on the presetting of both said divider 107 by means of rotary switch 123 and selector 109. Then, the pouring is started for the first component to such a level. The pouring of the first component is then discontinued and the volumetric value corresponding to the second component is set on selector 109 as added. The "formulation" push-button is again depressed, and as a result said rod 114 is lifted to a level corresponding to such a value, as shown by display 110, then the second component is poured to the preselected level and displayed, and so on. When all of the components have been poured to reach the value of 1000 cc for the formulation, at which said rod 114 defines a volume of 3000 cc in the container, the "free upward movement" push-button is acted upon, thus lifting said rod 114 to the position of top limit stop, enabling to remove container R containing the composite product thus prepared. Now, still using a 6000 cc container, should it be desired to prepare 3700 cc of the same composite product, the same process as above described will be followed, with the only exception that through selector 109 said divider 107 will be set to position II.

For only illustrative purposes, an example will now be given in connection with preparing pastel hue Blue 456 FIAT 76 RM, having the following formula:

| | | |
|---|---|---|
| Supermax RM TE | 08 | 100 |
| Supermax RM TE | 21 | 490 |
| Supermax RM TE | 25 | 809 |
| Supermax RM TE | 31 | 906 |
| Supermax RM TE | 41 | 988 |
| Supermax RM TE | 94 | 1000 |

Having chosen the volumetric amount to be prepared and the relative container R, the corresponding position of the divider is chosen, then subsequently setting on said selector 109: value 100 for the first component TE 08, value 490 for the addition of the second component TE 21, value 809 for the addition of the third component TE 25, value 906 for the addition of the fourth component TE 31, value 988 for the addition of the fifth component TE 41, and value 1000 for the addition of the last component TE 94. Thus, the desired composition has been provided. Now, should it be desired to prepare a different amount in a container of different capacity, divider 107 is first set to the corresponding position by means of rotary switch 123, and then the preceding values are set in the same sequence in said selector 109.

Of course, the invention principle being unaltered, those skilled in the art can now make changes and modifications to the assembly and single constructive details without departing for this from the scope and covering field of the invention.

What I claim is:

1. A stirring and metering device for mixing contents of containers and for metering the contents of a mixture using predetermined portions of the mixed contents of selected containers, said stirring and metering device comprising:

a housing;

a plurality of shelves supported by said housing;

a plurality of first magnetic means arranged in a series in each of said shelves, said shelves having upper surfaces with portions shaped to define bearing surfaces surrounding each of said first magnetic means;

common drive means for rotatably driving each of said first magnetic means;

second magnetic means comprising magnetic means rotatably driven by said first magnetic means, a stirring shaft connected to said magnetic means, and means for rotatably supporting said stirring shaft in a top of a container placed on one of said bearing surfaces, the stirring shaft being supported in such manner that said magnetic means is closely spaced from said first magnetic means so that magnetic attraction therebetween presses the container on to said bearing surface; and a rod type level indicating device positioned on said housing for metering contents of a mixture using predetermined portions of the mixed contents of selected containers, the contents of the containers being mixed by the rotation of said first magnetic means prior to metering.

2. A stirring device for mixing the contents of containers or vessels, particularly for paints, dyes and the like, comprising at least one first magnetic means; a fixed seat or housing enclosing said first magnetic means; means for rotatably driving said first magnetic means; and a second magnetic means comprising magnetic cooperating means cooperating with said first magnetic means, a stirring shaft for supporting said magnetic cooperating means, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said fixed seat or housing, said first magnetic means comprising a spider of permanent magnets of opposite sign, that is positive and negative, in an alternate arrangement, said first magnetic means being supported at the bottom by a support, and said magnetic cooperating means of said second magnetic means comprising a similar spider of positive and negative alternating permanent magnets, so that, in operation, the magnets of the first magnetic means and the magnets of the magnetic cooperating means of opposite sign are facing one another and directly superimposed with a substantial mutual attraction.

3. A device according to claim 2, characterized in that said magnets comprise ceramic magnets.

4. A device according to claim 2 characterized in that said magnets comprise oriented ceramic magnets transversely magnetized on the major surfaces.

5. A stirring device for mixing the contents of containers or vessels, particularly for paints, dyes and the like, comprising a plurality of first magnetic means; fixed means defining a plurality of superimposed shelves enclosing said first magnetic means; means for rotatably driving said first magnetic means including a main driving member and a plurality of members driven by the main driving member; and a second magnetic means comprising magnetic cooperating means cooperating with said first magnetic means, a stirring shaft for supporting said magnetic cooperating means, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said fixed seat or housing.

6. A device according to claim 5, characterized in that said means for rotatably driving includes a drive motor for the first magnetic means, the motor being a reversal type of motor to allow alternate rotation of stirring shafts of said second magnetic means.

7. A stirring device for mixing the contents of containers or vessels, particularly for paints, dyes and the like, comprising at least one first magnetic means; a fixed seat or housing enclosing said first magnetic means; means for rotatably driving said first magnetic means; and a second magnetic means comprising magnetic cooperating means cooperating with said first magnetic means, a stirring shaft for supporting said magnetic cooperating means and carrying mixing blades, said stirring shaft being rotatably mounted and centered in the cover of each container, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said fixed seat or housing.

8. A stirring device for mixing the contents of containers or vessels, particularly for paints, dyes and the like, comprising at least one first magnetic means having pole pieces; a fixed seat or housing enclosing said first magnetic means and including a sheet or plate closing said fixed seat or housing and forming a bearing surface for a container, the bearing surface including means defining bearing positions for containers, so as to be centered with respect to the underlying first magnetic means, the bearing positions for containers comprising a planar surface, on which ridges or raised portions having flat top surfaces are provided at each set of pole pieces of said first magnetic means, each of said ridges or raised portions having a predetermined shape corresponding to an inner portion of a container bottom spaced inside a corner edge of the container, so that said edge will rest on the planar surface and the inner bottom of the can will rest on the planar surface and the inner bottom of the container will rest on the top flat surface of the ridge or raised portion; means for rotatably driving said first magnetic means; and a second magnetic means comprising magnetic cooperating means cooperating with said first magnetic means, a stirring shaft for supporting said magnetic cooperating means, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said, fixed seat or housing.

9. A stirring device for mixing contents of containers or vessels, particularly for paints, dyes and the like, comprising a plurality of first magnetic means arranged in series; means for defining a heated single seat or housing forming a shelf for enclosing said first magnetic means; means for rotatably driving said first magnetic means, said driving means including a single driving member for driving all of said first magnetic means; and a second magnetic means comprising magnetic cooperating means cooperating with said first magnetic means, a stirring shaft for supporting said magnetic means, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said fixed seat or housing.

10. A device according to claim 9, characterized in that the shelf is provided with two resistances arranged longitudinally along the sides of said seat or housing.

11. A device according to claim 10, characterized in that said resistances are shielded by asbestos sheets and the heat dispersion is laterally reduced by means of air chambers provided below said resistances.

12. A stirring device for mixing the contents of containers or vessels, particularly for paints, dyes and the like, comprising a plurality of first magnetic means arranged in series, means defining a shelf for enclosing said first magnetic means; means having a single driving member for rotatably driving all of said first magnetic means, said driving member comprising a belt driving said plurality of first magnetic means, said driving means including a driving pulley for driving said belt, and a single motor for driving said pulley; and a second magnetic means comprising magnetic cooperating means cooperating with said first magnetic means, a stirring shaft for supporting said magnetic cooperating means, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said fixed seat or housing.

13. A stirring device for mixing the contents of containers or vessels, particularly for paints, dyes and the like, comprising a plurality of first magnetic means arranged in series; means defining a shell for enclosing said first magnetic means; means having a single driving member for rotatably driving all of said first magnetic means; a support for each of said first magnetic means; a gear wheel secured concentrically with each of said supports, the supports being connected to the shelf in such manner that adjacent gear wheels are meshing with the gear wheels adjacent thereto; said means for rotatably driving including a driven pinion for driving one of said gear wheels; and a second magnetic means comprising magnetic cooperating means cooperating with said first magnetic means, a stirring shaft for supporting said magnetic cooperating means, and means for rotatably supporting said stirring shaft in a cover of the container or vessel positioned on said fixed seat or housing so that said magnetic cooperating means is spaced from said first magnetic means whereby rotation of said first magnetic means is transferred to the second magnetic means, magnetic attraction between said first magnetic means and said second magnetic means holding said container pressed against said fixed seat or housing.

14. A device according to claim 13, characterized in that each gear wheel has a central hole and is secured to said fixed seat or housing forming said shelf by means of a pin which is inserted in said central hole, and then riveted on the sheet or plate forming the bottom of said seat or housing.

* * * * *